United States Patent [19]

Rushanan

[11] Patent Number: 4,827,810

[45] Date of Patent: May 9, 1989

[54] CROWFOOT TOOL

[75] Inventor: Joseph Rushanan, Bedford, Ohio

[73] Assignee: Stanley Air Tools-Division of the Stanley Works, Cleveland, Ohio

[21] Appl. No.: 786,587

[22] Filed: Oct. 11, 1985

[51] Int. Cl.[4] ..... B25B 21/00

[52] U.S. Cl. ..... 81/57.29; 81/57.13

[58] Field of Search ..... 81/57.14, 57.13, 57.29

[56] References Cited

U.S. PATENT DOCUMENTS

| | | | |
|---|---|---|---|
| 3,477,318 | 9/1967 | Batten | 81/57 |
| 3,535,960 | 4/1968 | Borries | 81/57.13 |
| 3,602,071 | 8/1971 | Juhasz | 81/57.14 |
| 3,987,692 | 10/1976 | Lesner et al. | 81/57.13 |
| 4,372,026 | 2/1983 | Mosing | 81/57.14 |
| 4,506,567 | 3/1985 | Makhlouf | 81/57.3 |

*Primary Examiner*—James G. Smith

*Attorney, Agent, or Firm*—Hayes & Reinsmith

[57] ABSTRACT

A tool is provided with an output extension head having parallel sets of drive trains drivingly connecting an input drive gear and an output socket gear. The drive trains each have individual idler gears in mesh with both the input drive gear and output socket gear to significantly increase the ultimate torque capacity of the tool without increasing the thickness of the gear components or the radial dimensioning of the output end of the extension head.

6 Claims, 4 Drawing Sheets

CROWFOOT TOOL

FIELD OF THE INVENTION

This invention generally relates to power tools and particularly concerns fastener-setting tools of a type commonly called "crowfoot" tools for setting hard-to-reach fasteners.

BACKGROUND OF THE INVENTION

In setting threaded fasteners in mass production operations, power tools are customarily used to achieve both speed and accuracy in a final torque setting of a fastener to predetermined specifications. Hard-to-reach fasteners require tools with special reaching devices. One such conventional class of devices comprises a flat train of gears between a drive of a power tool and an output socket wherein the socket itself is a final gear of that train. Such a flat gear train device when utilized wth a power tool is called a crowfoot tool.

Ultimate torque capacity of such crowfoot tools is limited by the dimensions of the gear train device or output extension head which is necessary to reach a fastener. In this respect, the dimensions considered are the overall thickness of the head, the radius of the output end of that head and overall width of the head. When overloaded, stress on the gear teeth results in undesired damage. Such overloading commonly occurs when a desired fastener torque is relatively high and the width, thickness and radial dimensions referred to above are limited.

Torque capacity can be increased by increasing the thickness of the gear components alone (and thereby the thickness of the head), or by increasing the radial dimensions of the gear components and the head envelope width without increasing the head thickness. In practice, however, it is often imperative that the gear component thickness and radial dimensioning at the output socket gear end of the head remain constant due to dimensional constraints imposed by specific job applications.

OBJECTS OF THE INVENTION

A principal object of this invention is to provide an improved crowfoot power tool particularly useful in precisely setting a workpiece to a desired degree of tightness and which features an output extension head of significantly increased torque capacity to set hard-to-reach fasteners. Included in this aim is the seemingly conflicting objective of providing a crowfoot tool of the type described with an extension head utilizing gear components having radial and thickness dimensioning which remains substantially unchanged from that of conventional tools heretofore employed in the same given job applications.

Other objects will be in part obvious and in part pointed out in more detail hereinafter.

SUMMARY OF THE INVENTION

Torque capacity of such output extension heads in crowfoot tools is increased by this invention to achieve the above stated objects by employment of parallel sets of drive trains in the head with each train drivingly connecting an input drive gear and output socket gear and wherein the drive trains each have individual idler gears in mesh with both the input drive gear and output socket gear.

Figure 1:
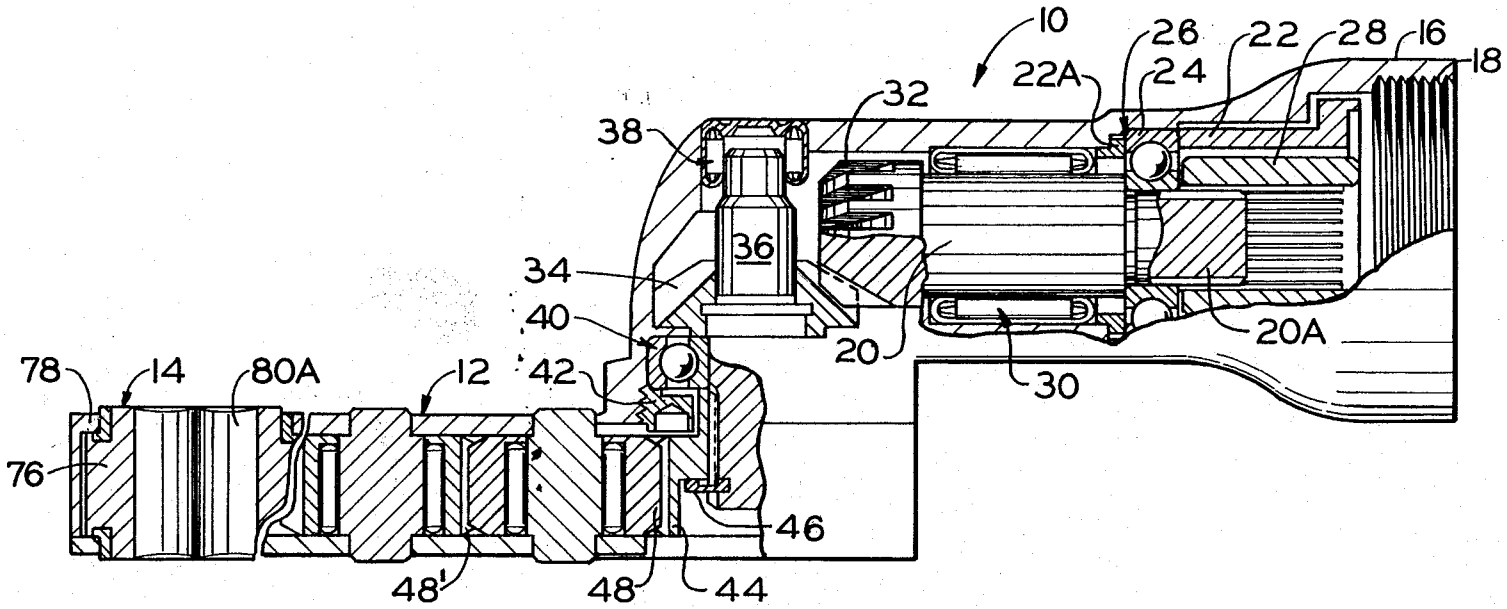
FIG. 1 is a fragmentary side view, partly in section and partly broken away, of a conventional crowfoot tool.
Figure 2:
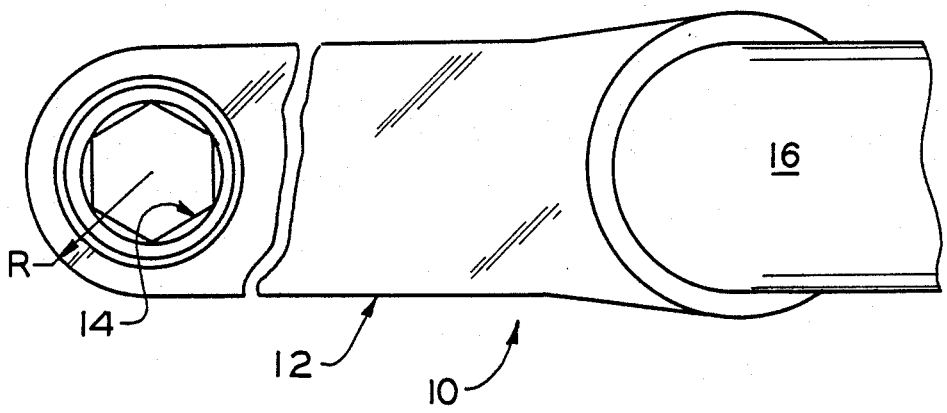
FIG. 2 is a plan view, partly borken away, of the tool of FIG. 1.

A better understanding of the objects, advantages, features, properties and relations of this invention will be obtained from the following detailed description and accompanying drawings which set forth certain illustrative embodiments and are indicative of the various ways in which the principle of this invention is employed.

DETAILED DESCRIPTION OF PREFERRED EMBODIMENTS OF THE INVENTION

Referring now to the drawings in detail, conventional crowfoot tools 10, 10A 10B are illustrated in FIGS. 1–5 showing extension heads 12, 12A, 12B on angle tool. Such extension heads can also be put on straight tools. These extension heads include a flat train of gears between a drive of the power tool to a final socket 14, 14A, 14B which itself serves as the final gear of the train and which is hereinafter called the output socket gear.

More specifically and as best seen in FIG. 1, an angle head housing 16 is shown threaded at 18 for connection to a motor housing portion, not shown, within which is housed a suitable motor, preferably a conventional rotary vane type air motor, for driving a spindle 20 mounted in angle head housing 16. Bearing spacers, such as shown at 22, 22A, position an outer race 24 of a bearing 26, and a spline coupling 28 is mounted in concentric relation to an input end 20A of drive spindle 20 supported for rotation within angle head housing 16 by a suitable needle bearing 50. Rotation of drive spindle 20 effects a drive connection through its bevel gear 32, which is in meshing engagement with bevel gear 34, to rotate an output spindle 36 which in the illustrated embodiment has its rotational axis oriented at 90° relative to the rotational axis of drive spindle 20. Output spindle 36 is supported within angle head housing 16 for rotation by suitable bearings such as the needle bearing at 38 and a ball bearing in part illustrated at 40 which in turn is secured in assembled relation with housing 16 by a suitable packing cap 42.

To provide a drive connection between the motor and the gears of the extension head 12, a single input drive gear 44 is splined to output spindle 36 and is fixed thereon by a suitable retaining ring 46. This input drive gear 44 is accordingly supported for rotation in unison with output spindle 36 and is in meshing engagement with an idler gear 48 of the gear train of the output extension head 12 which terminates in a final single gear of the train comprising output socket gear. Idler gear 48 may directly engage output socket gear 14 or there may be other idlers (such as shown at 48' in FIG. 1) in the flat gear train.

Figure 3:
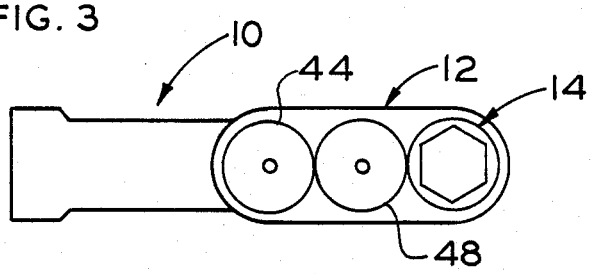
PRIOR ART FIG. 3
FIGS. 3–5 are schematic plan views of crowfoot tools incorporating prior art extension heads.
Figure 4:
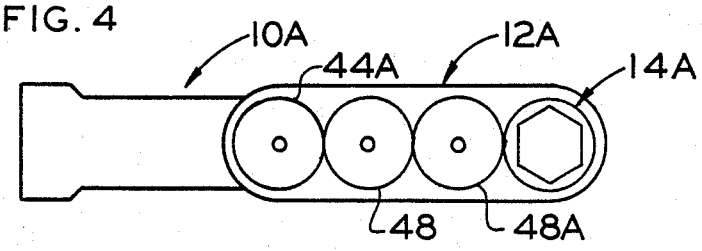
Figure 5:
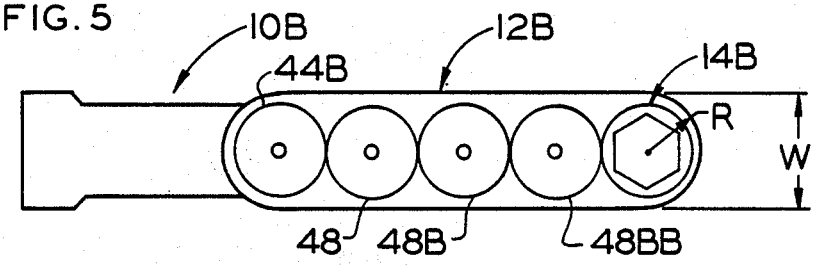

Further examples of typical crowfoot tools with conventional flat trains are shown in FIGS. 3–5 wherein the numbers 44, 48 and 14 are used in combination with different letters to respectively identify a single input the drive gear, idler gear(s) and a single output socket gear.

In addition to demands for greater loads and higher speeds with conflicting requirements for weight reduction, continued demands have been encountered prohibiting increase in thickness ("T" in FIG. 9) of the outside dimensions of the crowfoot tool extension and also precluding any increase in the radial dimension ("R" in FIGS. 1, 5 and 8) at the output end of the extension head. These requirements are the result of dimensionally restrictive locations wherein a fastener or workpiece may be located. Accordingly, any overloading of gear teeth may well result in their being damaged. Such overloading is not uncommon where a desired fastener torque is relatively high and the thickness of the gear components and radial dimensioning at the output end are limited by the job thereby resulting, in practice, in the requirement to maintain these particular parameters constant.

To preclude overloading, despite increased fastener torque requirements, while at the same time maintaining the above mentioned maximum limitations of the gear components thickness and radial dimensioning at the output end, the transmitted loading from a single initial driver (such as the input drive gear on output spindle 20) is deliberately shared in transfer, in accordance with this invention, from that single initial driver to that final single socket gear. Such load transmission is effected by the provision of bilaterally symmetrical linear gear trains which are more specifically described below and which are referred to hereinafter as parallel drive trains.

Figure 6:
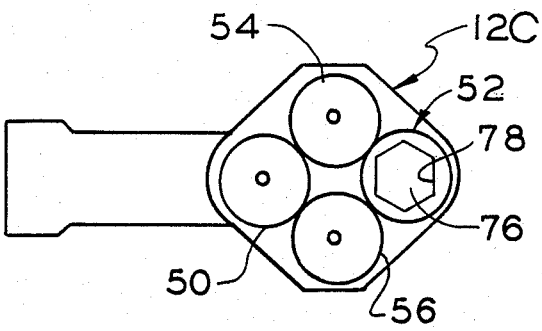
FIGS. 6–8 are schematic plan views showing tools incorporating this invention.
Figure 7:
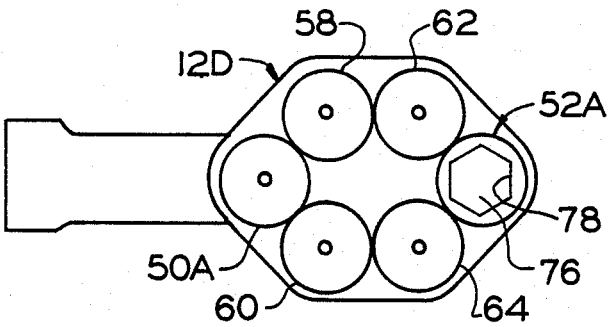
Figure 8:
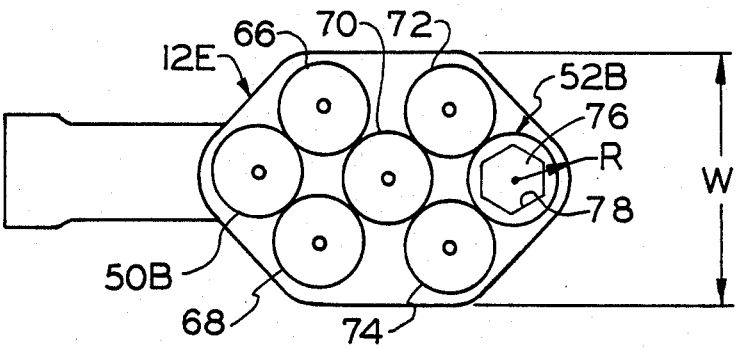
Figure 9:
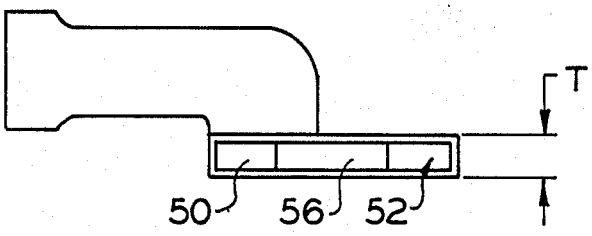
FIG. 9 is a schematic side view of the tool of FIG. 6.

Specific examples for significantly increasing ultimate torque capacity of crowfoot extension heads under such limitations are set forth in FIGS. 6–9. In each of these figures, an output extension head 12C, 12D, 12E is illustrated which includes an input drive gear, identified by the number 50, drivingly connected to the motor, not shown. An output socket gear of these extension heads 12C, 12D, 12E is identified by number 52. Parallel sets of drive trains are shown providing a continuous dual path of power transmission from the drive input to socket output whereby each single input drive gear 50, 50A, 50B is drivingly connected to each single output socket gear 52, 52A, 52B. Each of the drive trains has an individual idler gear directly in mesh with the input drive gear; each of the drive trains has an individual idler gear directly in mesh with the output socket gear. Each of the disclosed inventive tools as shown in FIGS. 6–9 are respectively juxtaposed a corresponding conventional flat train crowfoot device. In FIGS. 6–8 the input drive gear 50, 50A and 50B, the output socket gear 52, 52A, and 52B and each of the idler gears in the drive trains connecting the input and output sockets are shown to be simple gears each of which is drivingly engaged along its outer periphery. It will be understood that the thickness (and resulting overall extension thickness "T" in FIG. 9) and radial dimensioning at the output end (depicted by "R" in FIGS. 1, 5 and 8) are identical on each of the respective gear trains illustrated in the schematic drawings of FIGS. 6–8 and their corresponding conventional flat train devices as illustrated in FIGS. 3–5.

In FIG. 6, e.g., input drive gear 50 is in meshing engagement with a pair of drive trains which respectively comprise gear 50, individual idler gears 54 and 56 directly in mesh with input drive gear 50 and output socket gear 52. FIG. 7 shows an input drive gear 50A in mesh with individual idler gears 58 and 60 which in turn engage idler gears 62 and 64 for driving output socket gear 52A. Yet another example is illustrated in FIG. 8 wherein an input drive gear 50B is in mesh with idler gears 66 and 68 of two distinct gear trains (respectively additionally comprising gears 70, 72, and 52B and gears 70, 74 and 52B) with output socket gear 52B serving as the final single output socket gear of both gear trains. By such an arrangement, the actual transmitted loading is normally equally shared by the two gear trains between the single initial driver and the single output socket gear. Only the overall width "W" of the output extension head will be seen to have been increased.

The extension heads in FIGS. 6 and 7 are shown to have no common idler gears in the respective gear trains between the input drive gears 50, 50A and their respective output socket gears 52, 52A, whereas in the extension head of FIG. 8 there is shown an idler gear 70 which is common to both gear trains between the input drive gear 50B and the output socket gear 52B.

In each of the described embodiments, the single output socket gear 52 will be understood to have a toothed periphery providing an uninterrupted surface in constant meshing engagement with idler gears of the disclosed parallel gear trains. In addition, the output socket gear 52 has a non-circular central opening 76 which defines a plurality of internal fastener drive surfaces such as at 78.

By virtue of the above described construction, a crowfoot tool is disclosed which is particularly useful for setting hard-to-reach fasteners and which has significantly increased torque capacity for a tool with gear components of predetermined dimensioning.

As will be apparent to persons skilled in the art, various modifications, adaptations and variations of the foregoing specific disclosure can be made without departing from the teachings of this invention.

I claim:

1. A fastener setting power tool comprising a housing having an elongated body, a motor supported in the housing, an output extension head mounted on the housing, the head including an input drive gear drivingly connected to the motor, an output socket gear having an uninterrupted toothed outer periphery, the input drive gear and output socket gear being rotatable about spaced parallel axes, the housing body having a major longitudinal axis in perpendicular relation to the rotational axes of the input drive gear and output socket gear, and a set of parallel drive trains drivingly connecting the input drive gear and output socket gear, the drive trains each having individual idler gears in mesh with both the input drive gear and the output socket gear, said input drive gear, said output socket gear and each of said idler gears being in meshing engagement with adjacent gears along the outer periphery of each of said gears in the respective drive trains.

2. A fastener setting power tool comprising a housing, a motor supported in the housing, and an output extension head mounted on the housing, the head including an input drive gear drivingly connected to the motor, an output socket gear having an uninterrupted toothed outer periphery, and a set of parallel drive trains drivingly connecting the input drive gear and output socket gear, the drive trains each having individual idler gears in mesh with both the input drive gear and the output socket gear, said input drive gear, said output socket gear and each of the idler gears in each drive train being in meshing engagement wth adjacent gears along the outer periphery of each gear in the respective drive trains.

3. The tool of claim 2 wherein the output socket gear comprises a final single gear common to each drive train.

4. The tool of claim 2 wherein the output extension head provides an extended drive for fasteners setting applications in relatively remote relation to the input drive gear.

5. The tool of claim 2 wherein the motor is a fluid operated rotary motor.

6. The tool of claim 2 wherein each of said drive trains has no common idler gear with another of said drive trains between the input drive gear and the output socket gear.

* * * * *